US011250731B1

(12) United States Patent
Betz et al.

(10) Patent No.: US 11,250,731 B1
(45) Date of Patent: Feb. 15, 2022

(54) DISPLAY COLUMN SYSTEM

(71) Applicant: Vomela Specialty Company, St. Paul, MN (US)

(72) Inventors: Daniel Thomas Betz, Columbus, MN (US); Jed Joseph Heinzen, Zimmerman, MN (US); Kevin John Kuznar, Apple Valley, MN (US)

(73) Assignee: Vomela Specialty Company, St. Paul, MN (US)

( * ) Notice: Subject to any disclaimer, the term of this patent is extended or adjusted under 35 U.S.C. 154(b) by 0 days.

(21) Appl. No.: 17/019,452

(22) Filed: Sep. 14, 2020

Related U.S. Application Data

(60) Provisional application No. 62/980,858, filed on Feb. 24, 2020.

(51) Int. Cl.
*G09F 1/06* (2006.01)
*G09F 1/12* (2006.01)
*A47G 1/16* (2006.01)

(52) U.S. Cl.
CPC ..... *G09F 1/065* (2013.01); *A47G 1/1653* (2013.01); *G09F 1/12* (2013.01)

(58) Field of Classification Search
CPC .... G09F 1/065; G09F 1/12; G09F 2007/1804; G09F 2007/1813; G09F 2007/183; A47G 1/1653
See application file for complete search history.

(56) References Cited

U.S. PATENT DOCUMENTS 5,660,119 A * 8/1997 Perkins ..... B65D 19/0012 108/51.3
5,787,621 A * 8/1998 Leksell ..... G09F 15/0025 40/606.12
2008/0295374 A1* 12/2008 Bergland ..... G09F 1/065 40/607.1
2015/0093524 A1* 4/2015 Pulos ..... G09F 1/06 428/34.1
2019/0066549 A1* 2/2019 Sackett ..... E01F 9/608

* cited by examiner

*Primary Examiner* — Gary C Hoge
(74) *Attorney, Agent, or Firm* — Haugen Law Firm PLLP

(57) ABSTRACT

A display column system that includes interchangeable custom printed outer shells surrounds a structural internal frame and support. The display columns are particularly well suited for surrounding and coupling suspended poles or conduits elevated at various heights above the floor. Both the outer shell and internal frame are easily collapsed and fold flat for efficient transportation.

12 Claims, 18 Drawing Sheets

DISPLAY COLUMN SYSTEM

CROSS-REFERENCE TO RELATED APPLICATIONS

This application claims priority to U.S. Provisional Patent Application Ser. No. 62/980,858, filed on Feb. 24, 2020, the contents of which are being incorporated herein by reference in their entirety.

FEDERAL SPONSORSHIP

Not Applicable

Joint Research Agreement

Not Applicable

TECHNICAL FIELD

The present invention relates generally to portable three-dimensional, displays, and more particularly relates to elevated column displays that include interchangeable outer shells surrounded by a structural framework. Both the outer shell and framework are collapsible into planar panels for efficient transport. The structural framework may couple to and surround suspended poles or conduits elevated at various heights above the floor. The column display system further interconnects with minimal fasteners.

BACKGROUND

Retailers of merchandise in large buildings often utilize signs to direct or lead consumers to particular zones within the building. The signs may also be utilized to advertise or to provide additional information regarding particular merchandise within the building. Oftentimes indicia on the sign may only be visible from limited directions or other merchandise may obstruct the view of the sign. Thus, it may be desirable to elevate the signs or display above merchandise. However, the building structure may limit the ability to secure a sign in a particular desired area. Further, support beams and conduits may obstruct or limit the specific area or layout of a sign or display. Additionally, in the past, certain displays or signs have been positioned or fixed within an area of the building making it cumbersome or difficult to remove or to change portions of the indicia on the sign or display.

Many retailers attempt to duplicate the appearance and exact layout of the store at multiple locations. Changes to the floor plan or layout are typically designed off-site. The layout requirements may include the exact position, appearance, and custom printing of all signs and displays. Over time, the retailer may desire changes to a particular sign and may desire implementation of the change uniformly at all locations.

Although multi-dimensional displays may be preferable to catch the eye of a consumer, unvarying assembly and installation of these multi-dimensional signs at many locations may prove challenging. To reduce inconsistency the signs may be shipped to the various locations preassembled, however shipping preassembled displays significantly increases the shipping costs for each display. To further add to the overall cost, in the past, these signs and displays have typically been disposable. Although flat sheets have been hung from ceilings as advertisements or displays, the present invention provides interchangeable, interlocking, multi-dimensional, multi-faced columns, which are easily assembled and collapsed. The present invention further utilizes conduit or other obstructions to elevate the display column above eye level of the consumer. The present invention is made from renewable or recyclable materials and portions of the column display system are reusable.

SUMMARY

Embodiments according to aspects of the invention include a collapsible, outer shell, a collapsible internal framework and internal supports or braces that are assembled to form a self-contained column or pillar. The column or pillar may be coupled to and surround a portion of a conduit, power pole or other core. The outer shell may be formed from flat sheets of cardboard, foam board, or other material having a surface suitable for printing or alternatively having a surface suitable for receiving printed material adhered to the surface. Two pieces of sheet material having equal widths may be used to form the outer shell. A single score line is cut into each sheet and each sheet is folded along the score line. The two folded sheets are then combined to form the four-sided display column or pillar. Alternatively, the outer shell may be formed by cutting three longitudinal v shaped score lines or grooves into one side but not completely through a single sheet material having an appropriate width. The grooves are cut into the surface that is intended to be the internal surface of the outer shell. The cut material is removed from the groove and the sheet material may be folded at the score lines. The outer side or surface acts as a hinge. The distance between the longitudinal cuts may be chosen such that when the sheet material is folded at the score lines, a pillar having four sides is formed.

Similarly, the internal framework may be formed from flat sheets of a corrugated board, honeycomb board or other suitable material having a core that separates an outer and inner sheet material. The framework may be formed by cutting three longitudinal v shaped score lines or grooves into the outer sheet material and core but not through the inner sheet material. The grooves are cut into the surface that is intended to be the outer surface of the framework. The cut material is removed from the groove and the sheet may be folded at the score lines. The inner sheet material acts as a hinge. The distance between the longitudinal cuts may be chosen such that when the sheet material is folded at the score lines, the framework having four sides is formed. The width of the sides of the framework is selected so that the outer shell wraps around and slightly contacts the framework. The internal frame may have cutouts or windows formed in the material to reduce weight of the frame. The material from the cutouts may be modified or cut to form the internal supports (thereby reducing unused or waste material). The flat sheets are cut dependent upon the overall desired size and desired shape of the outer shell.

In an embodiment in accordance with the present invention the display column system includes an interchangeable, custom printable outer shell, a reusable, collapsible internal frame, and internal supports. The display column system or pillar is particularly well suited for use by retailers. The retailer may efficiently assemble and attach the system to a power pole conduit or support brace within the store. The system may preferably have a length of about 72 inches and may be elevated approximately 10 feet off the ground. In this manner, all four sides of the column of the present invention could be visible to the shopper from ground level anywhere in the store. The retailer may custom print store department information on the outer shell to help customers find a particular area within the store. The outer shell, internal frame and internal support are preferably made of a sustainable material and assembly is accomplished without fasteners.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
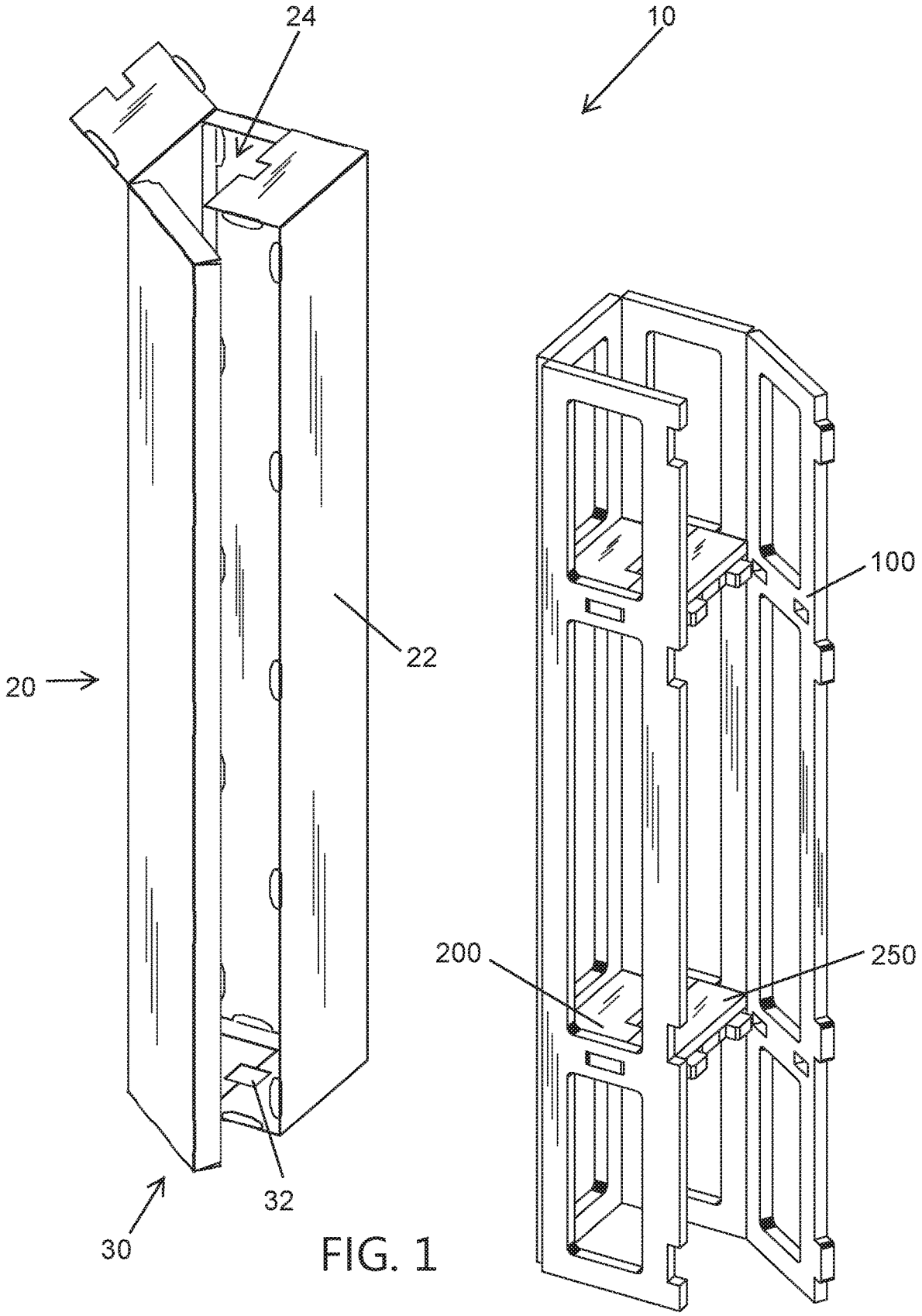
FIG. 1 is a top front perspective view of an embodiment of a display column system of the present invention.
Figure 2:
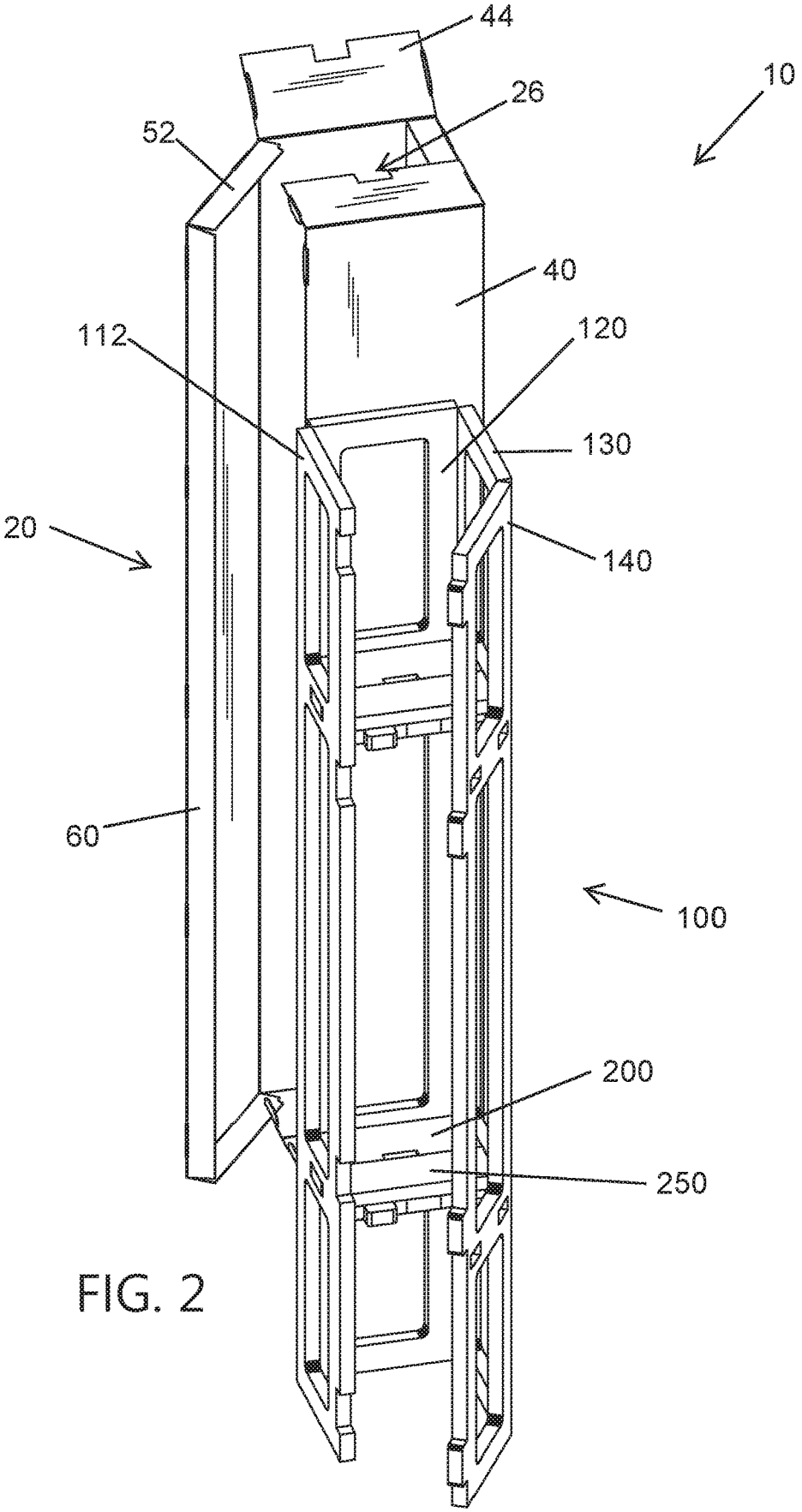
FIG. 2 is a top right side perspective view of the display system of the type shown in FIG. 1.
Figure 3:
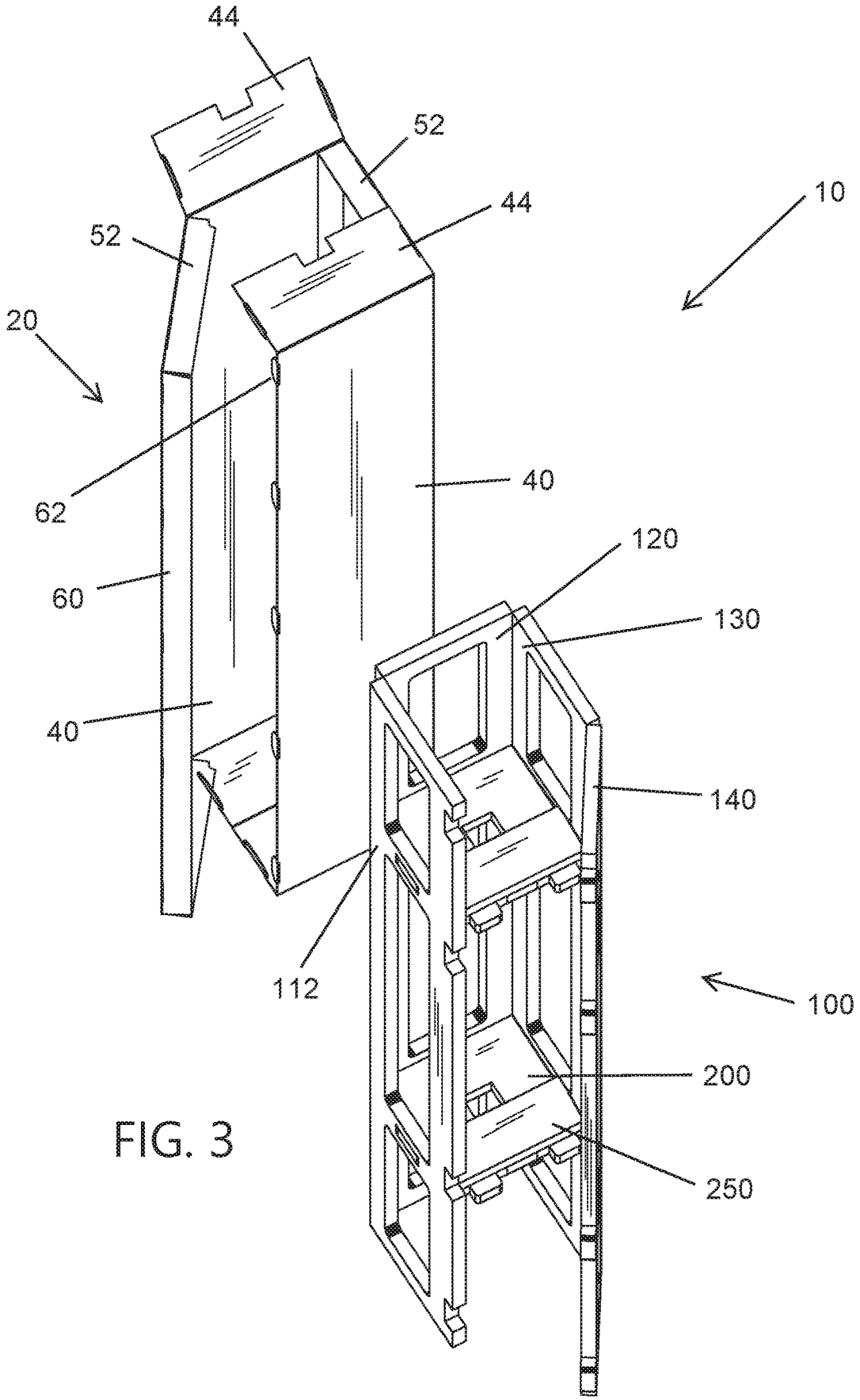
FIG. 3 is a top right side perspective view of the display system of interlocking units of the type shown in FIG. 1.
Figure 4:
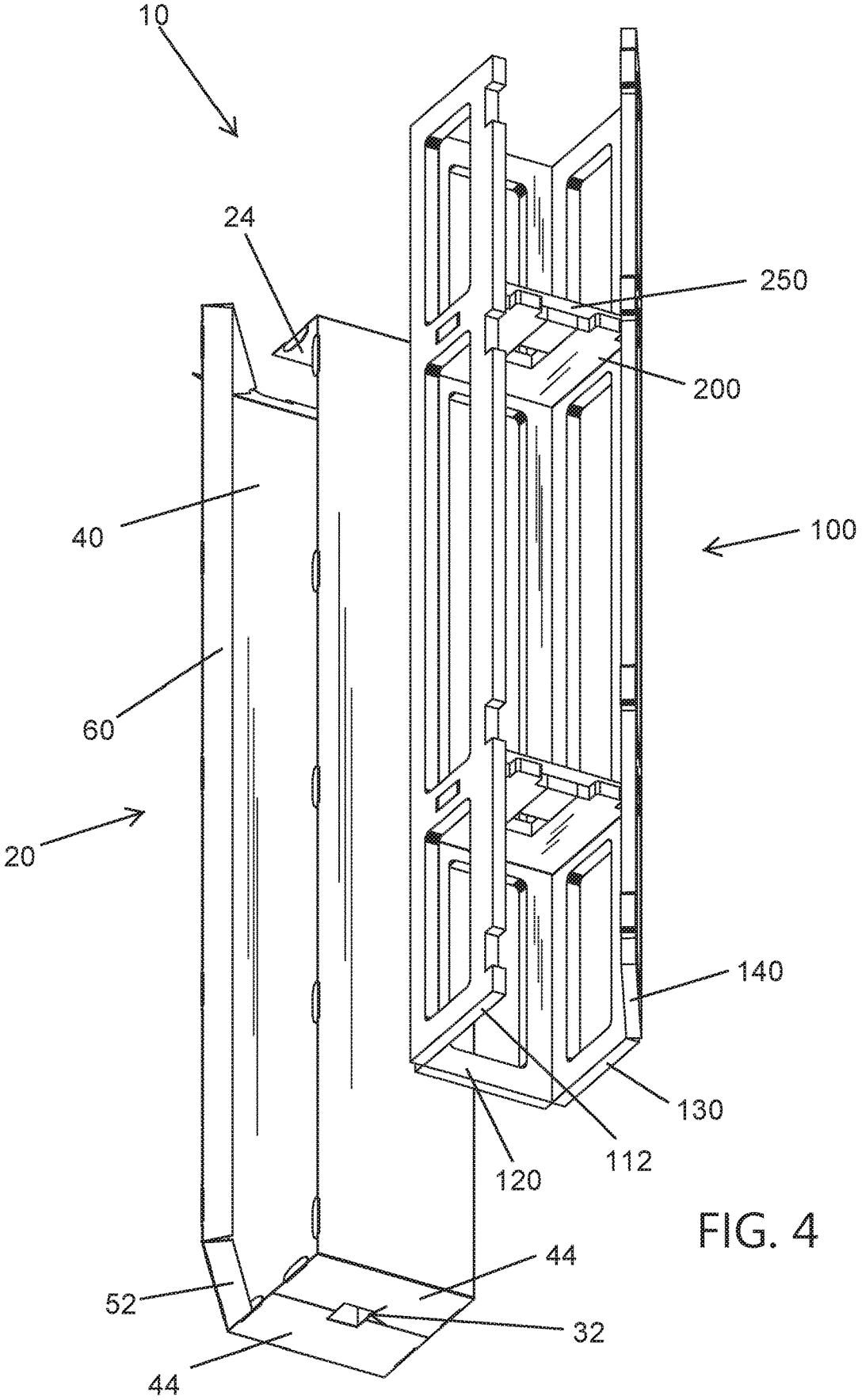
FIG. 4 is a bottom right side perspective view of an embodiment of a display system of the present invention.
Figure 5:
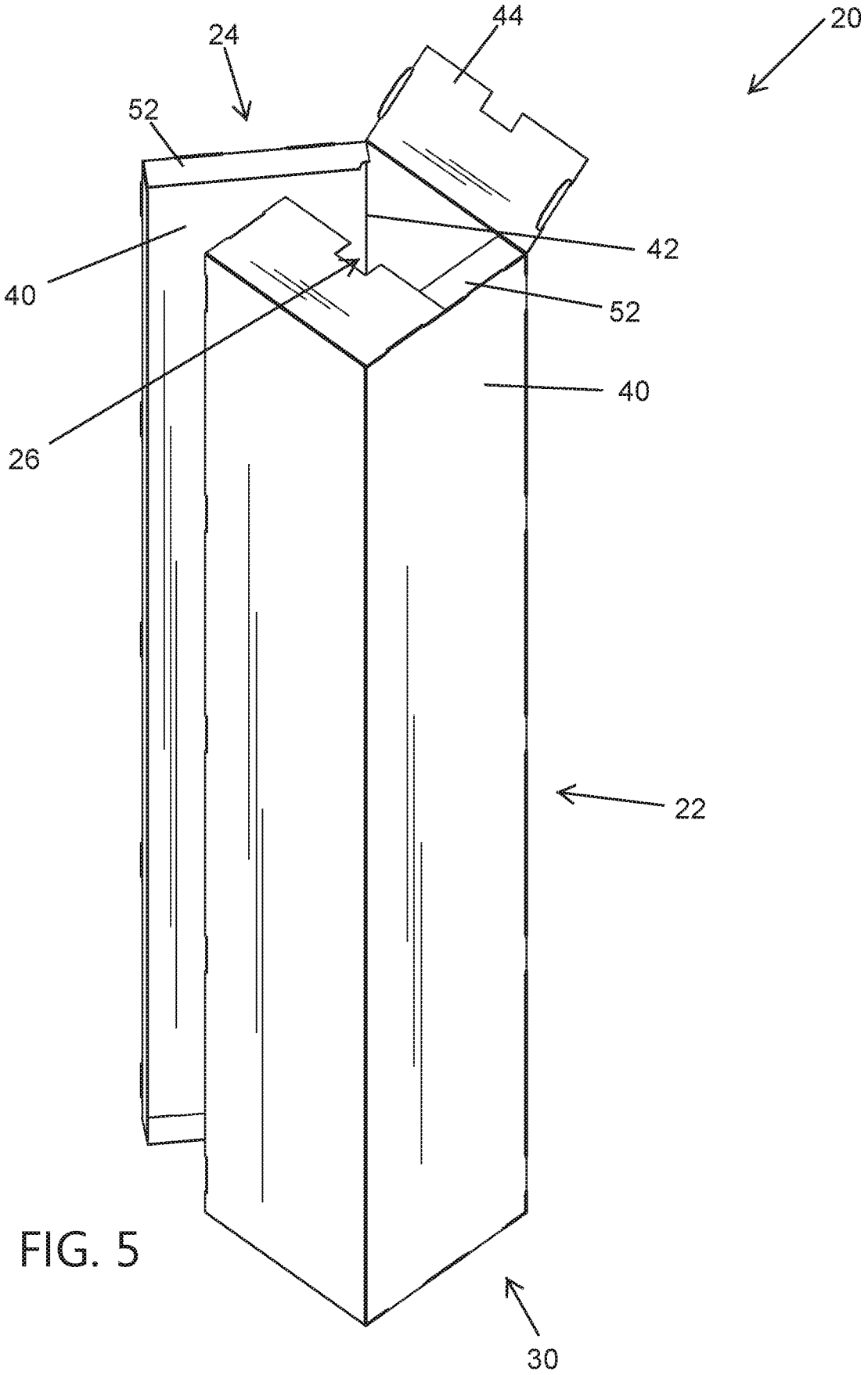
FIG. 5 is a top perspective view of an outer shell of a display system of the present invention.
Figure 6:
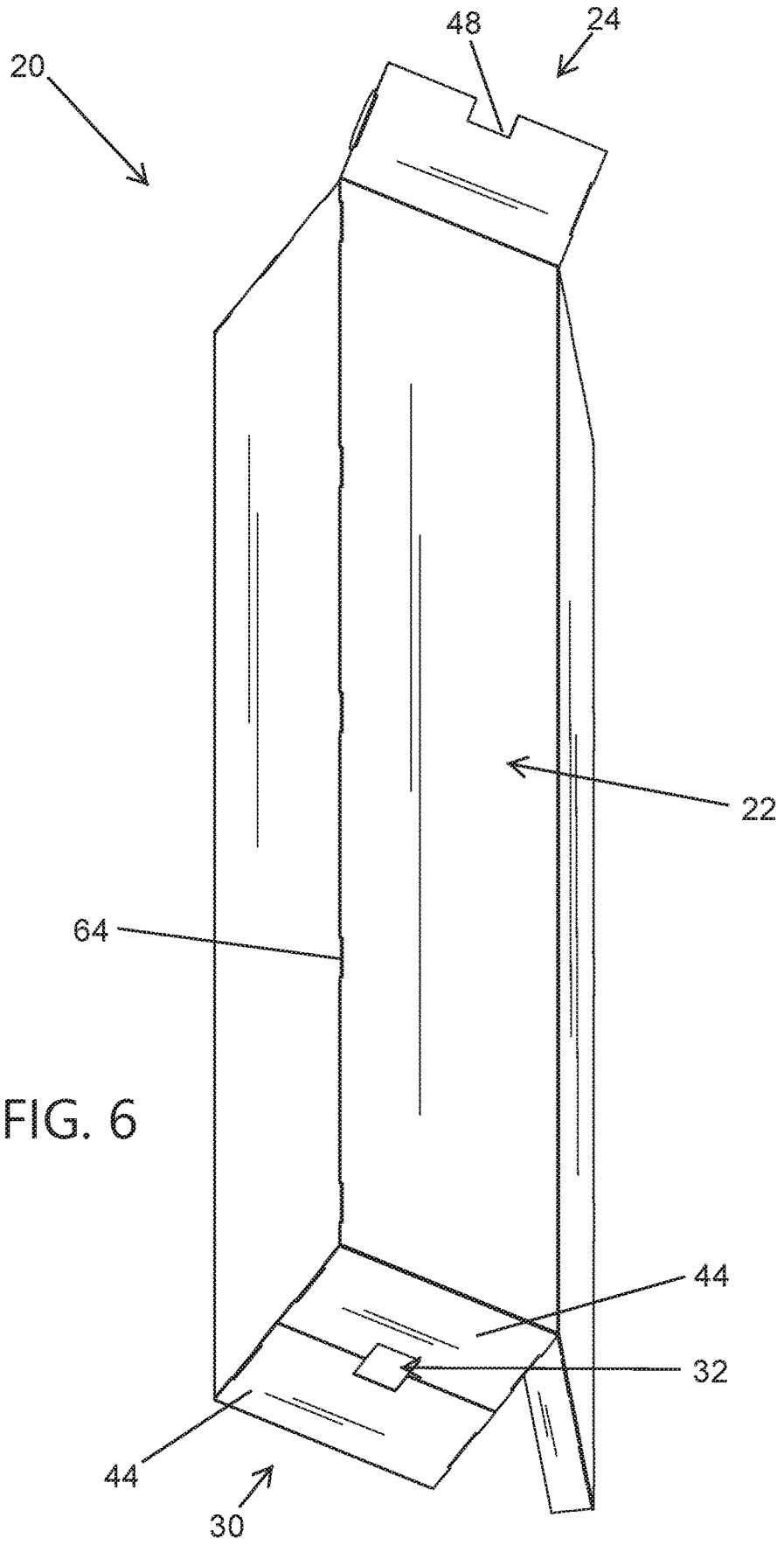
FIG. 6 is a bottom perspective view of the outer shell of the type shown in FIG. 5.
Figure 7:
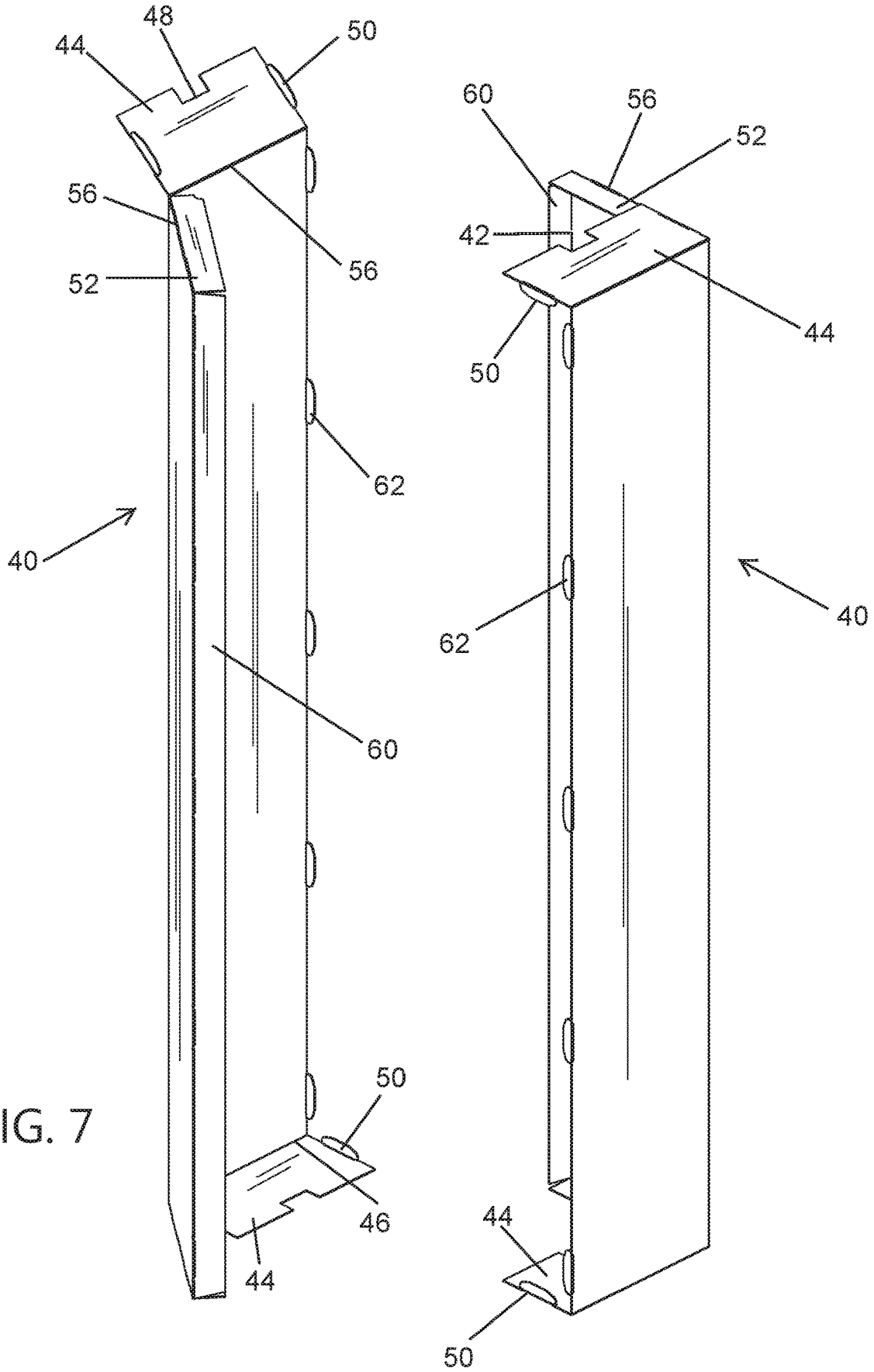
FIG. 7 is a top perspective view of two halves of the outer shell of the type shown in FIG. 5.
Figure 8:
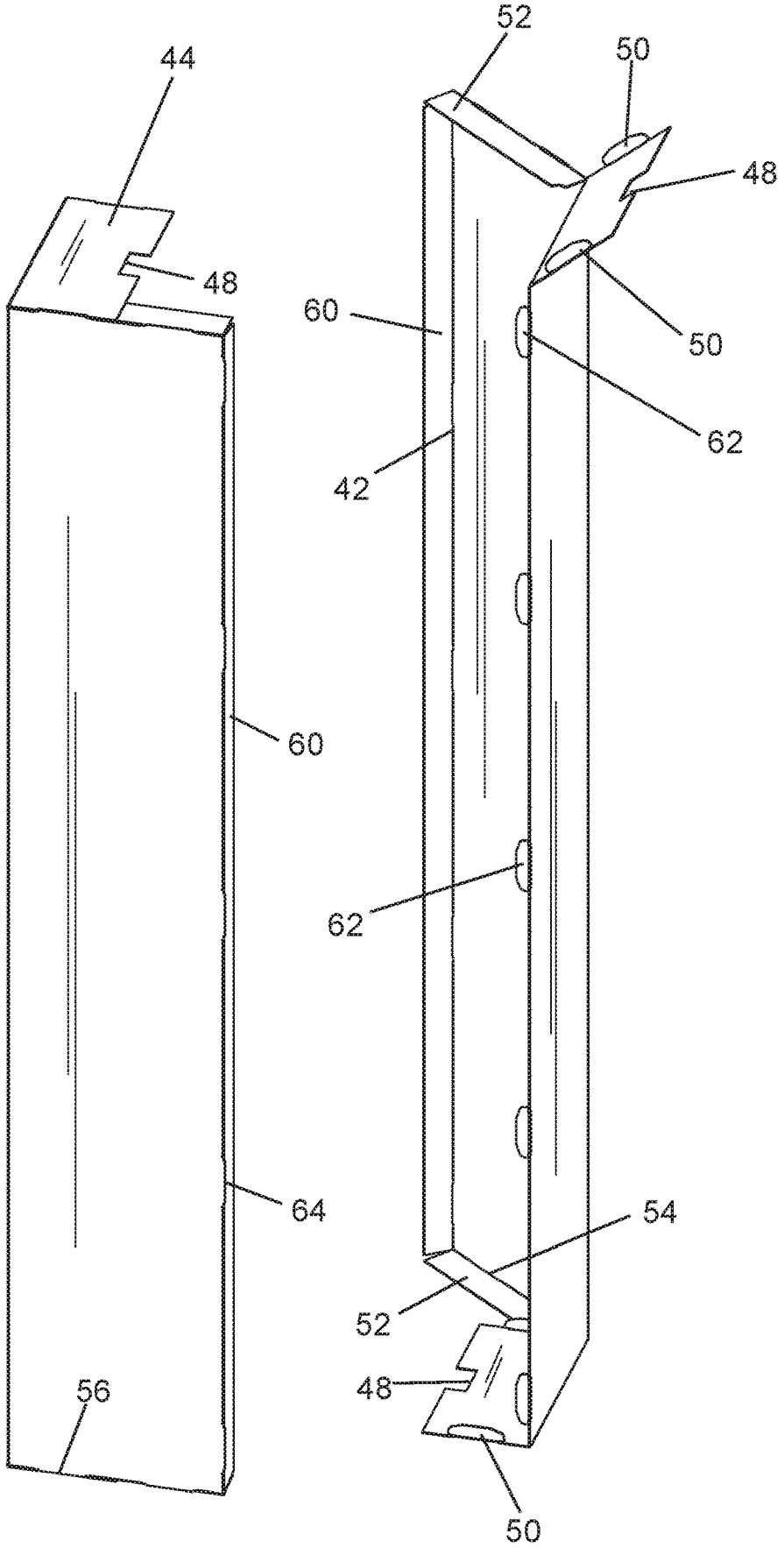
FIG. 8 is a top perspective view of two halves of the outer shell of the type shown in FIG. 5.
Figure 9:
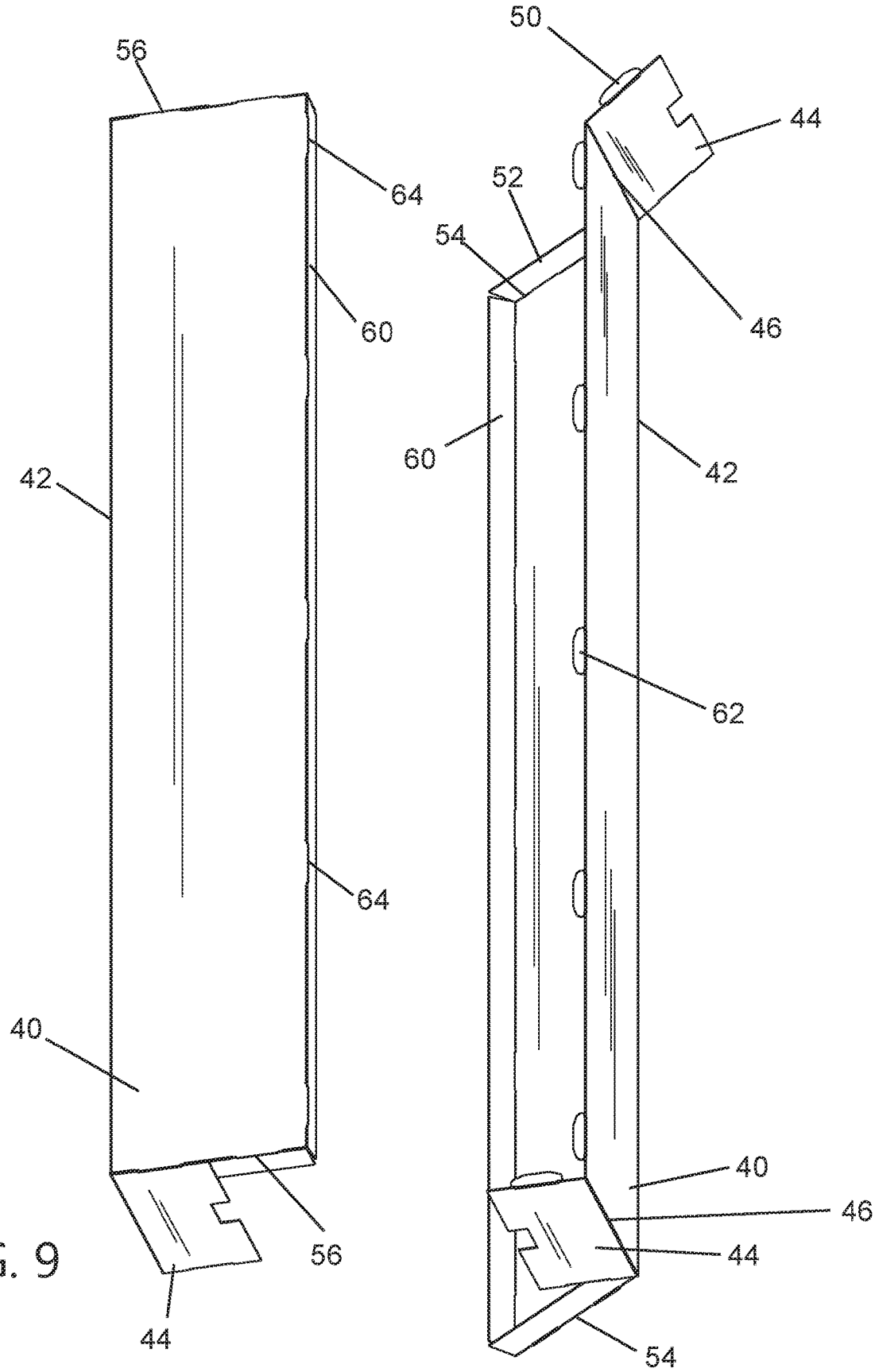
FIG. 9 is a bottom perspective view of two halve of the outer shell of the type shown in FIG. 5.
Figure 10:
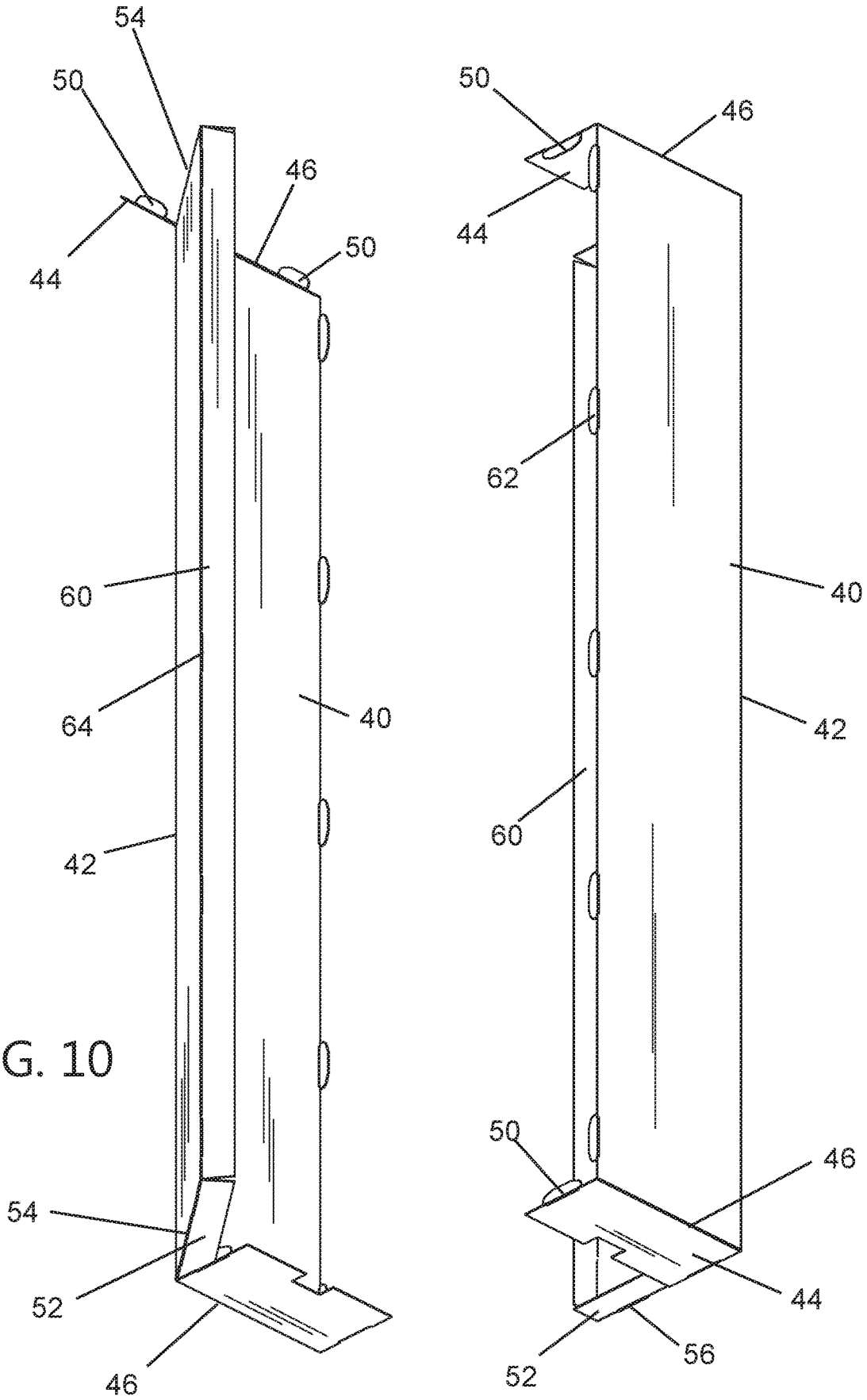
FIG. 10 is a bottom perspective view of two halves of the shell of the type shown in FIG. 5.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The apparatus of the present invention is particularly well suited for retail displays. Although the invention will be described in the context of a long three-dimensional column or pillar those skilled in the art will appreciate that the novel concepts of the invention may be incorporated into other three-dimensional shapes. The display column system 10 of the present invention generally includes an interchangeable outer shell 20, an inner frame 100 and supports 200. The apparatus is particularly well suited for custom printing on the outer shell 20 of the column 10. The outer shell 20 is interchangeable and is formed from renewable or recyclable materials. Further, the outer shell 20 of the retail display may be interchanged or replaced without entirely disassembling or dismounting the inner frame 100.

Turning attention now to the Figures, embodiments of the display column system 10 of the present invention will now be described in more detail. With reference to FIGS. 1-4 the column system 10 includes an interchangeable outer shell 20, inner frame 100, supports 200 and containment blocks 250. The outer shell 20 has a top 24, bottom 30 and sides 22. A top aperture 26 is formed by the top 24 and a bottom aperture 32 is formed by the bottom 30. The outer shell is comprised of two identical halves 40 that interlock to form the outer shell. Each half 40 includes a top and bottom flap 44 and a top and bottom support flap 52. Extending between the top 24 and bottom 30 is a longitudinal flap 60 along one side edge and longitudinally spaced apart tabs 62 along the other edge. The tabs 62 interlock into slots extending into an edge of the longitudinal flap 60. The inner frame 100 includes first side 112, second side 120, third side 130, and fourth side 140. The frame is held in place and structurally supported by supports 200 and optional blocks 250.

Referring next to FIGS. 5-10, these Figures illustrate the two halves 40 of the outer shell 20 in greater detail. Each half 40 includes a top and bottom flap 44 and a top and bottom support flap 52. Extending between the top 24 and bottom 30 is a longitudinal flap 60 along one side edge and longitudinally spaced apart tabs 62 along the other edge. The tabs 62 interlock into slots 64 extending into an edge of the longitudinal flap 60. Each half 40 may be formed from a flat sheet of cardboard, foam board, or other material having a surface suitable for printing. The flat sheet material includes an outer layer and inner layer separated by a core material. A longitudinal v shaped score line 42 is cut into each sheet 40 and each sheet is folded inward along the score line 42. The v shaped score lines or grooves are cut into the inside layer and core of the sheet but does not completely cut through the sheet material. The grooves are cut into the surface that is intended to be the internal surface of the outer shell. The outer side or surface acts as a hinge such that the two folded sheets are then combined and interlocked to form the four-sided column or pillar.

At each end a lateral score line 46 is cut into the sheet so that when the sheet is folded along the score line 46 a flap 44 is formed at each end. A separate lateral score line 54 is cut into each end of the sheet such that when the sheet is folded along the score line 54 support flap 52 is formed on each end. Slots 56 are cut through the out layer along the score line 54. The slots 56 are adapted for receiving tabs 50 extending from side edges of each flap 44. Each flap further includes a cutout 48. When the two halves 40 are interlocked together and the flaps are folded down and interlocked with the support flaps 52, the cutouts or void area 48 form the top and bottom apertures 26 and 32.

Figure 11:
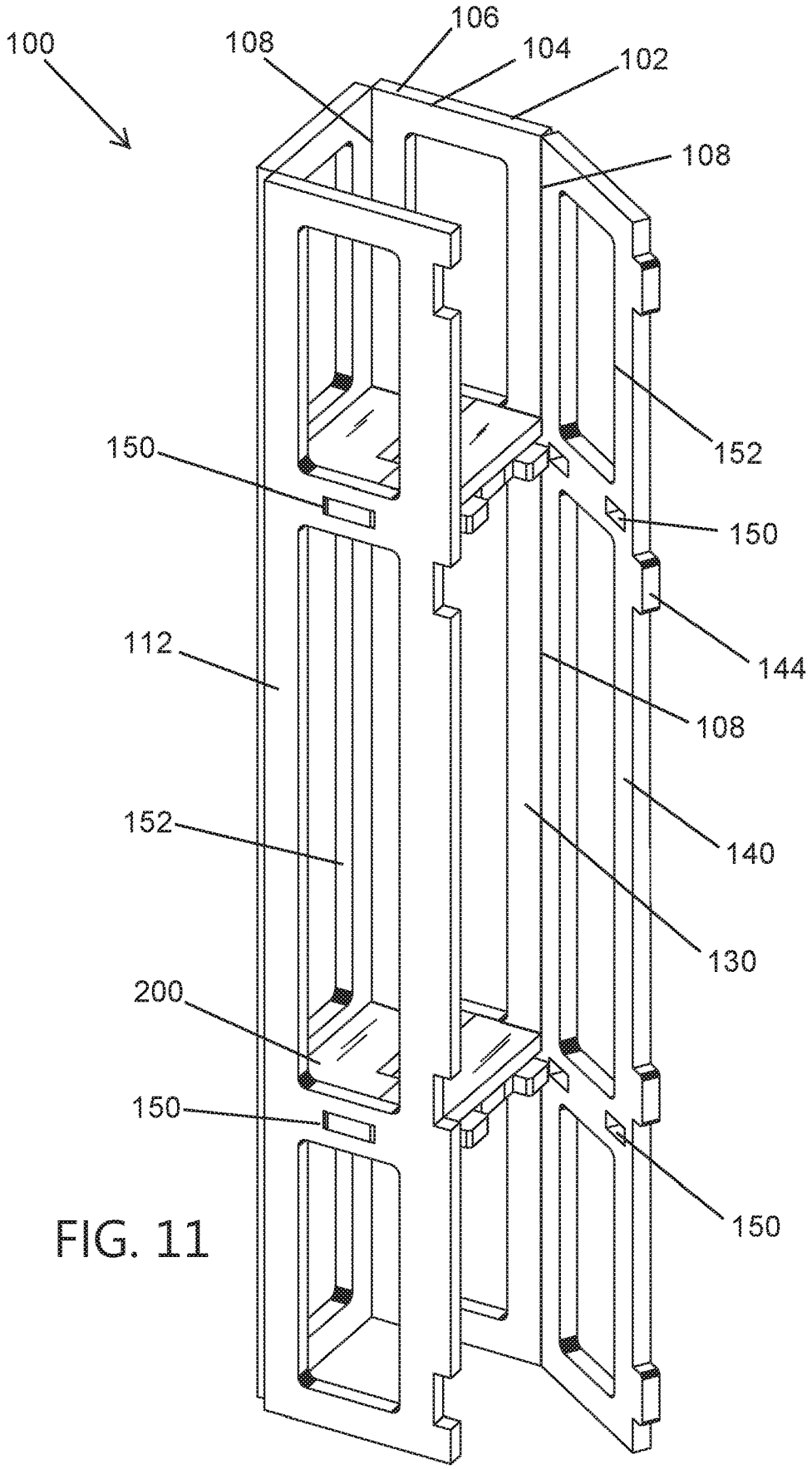
FIG. 11 is a top perspective view of an inner frame and supports of a display system of the present invention.
Figure 12:
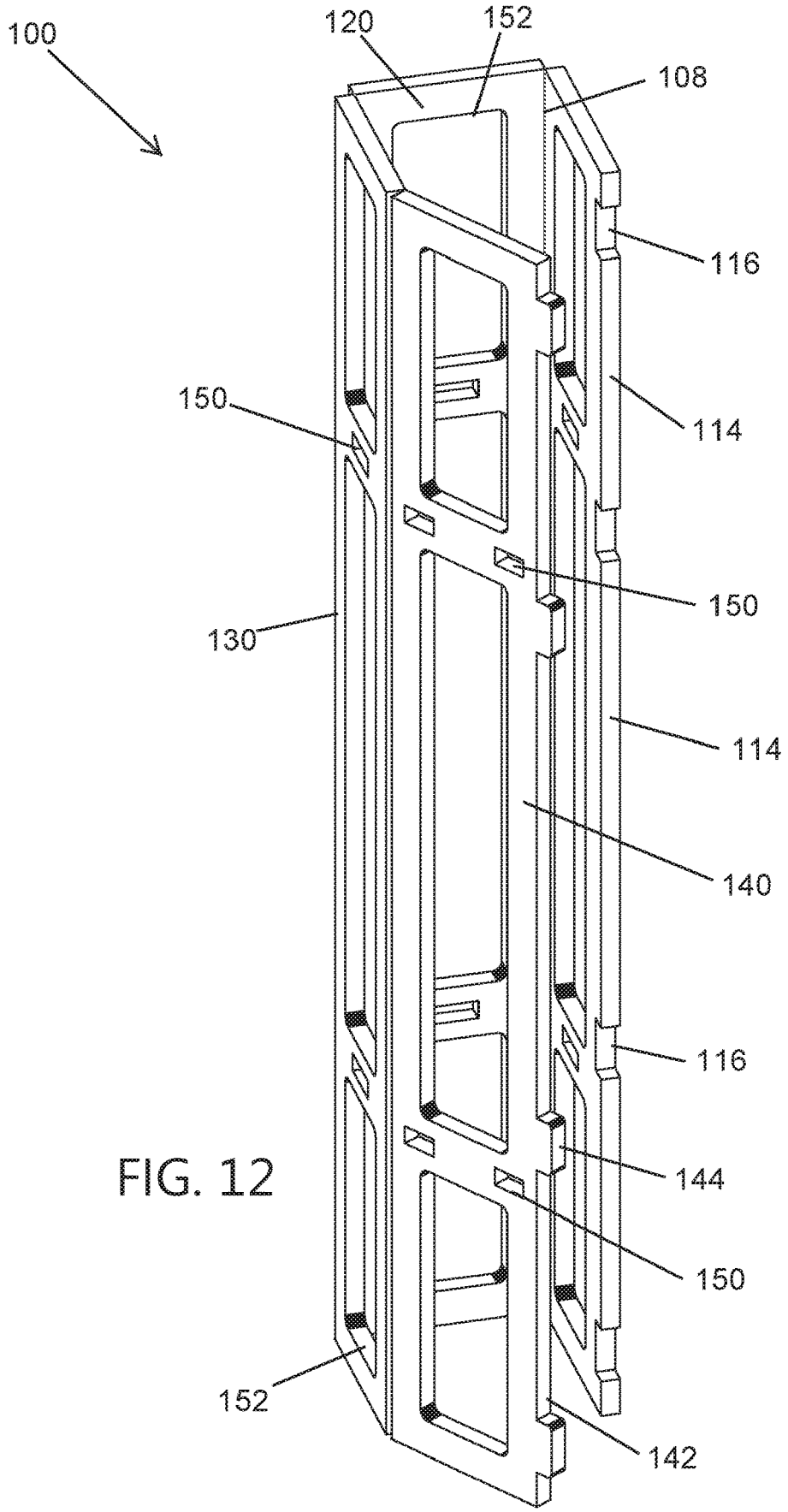
FIG. 12 is a top perspective view of the inner frame and supports of the type shown in FIG. 11.
Figure 13:
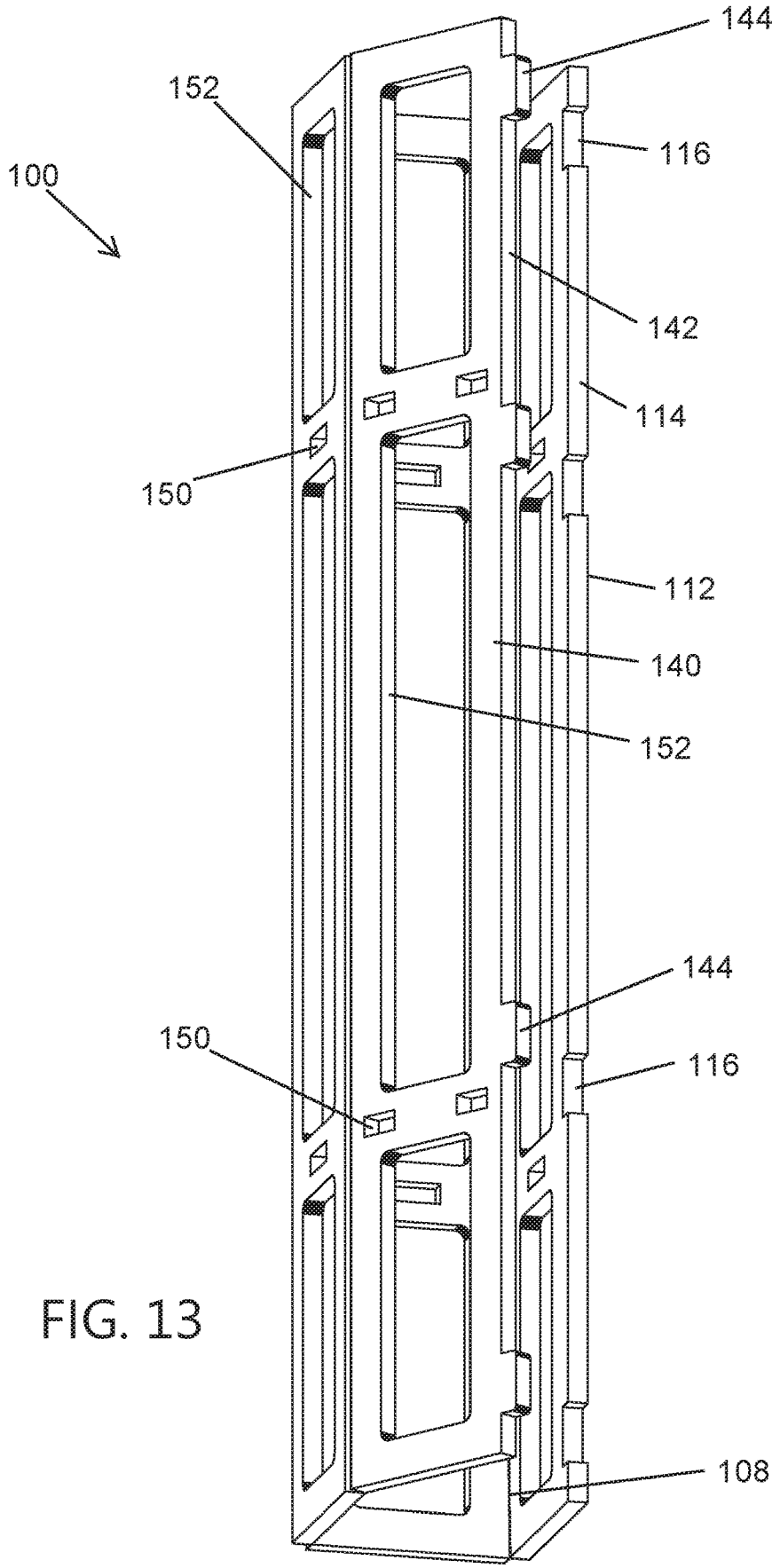
FIG. 13 is a bottom perspective view of the inner frame and support of the type shown in FIG. 11.

Referring next to FIGS. 11-13 the inner frame 100 will be described in greater detail. The inner frame 100 includes first side 112, second side 120, third side 130, and fourth side 140. The inner frame 100 is formed from a flat sheet of a corrugated board, honeycomb board or other suitable material having a core 106 that separates an outer sheet or layer 102 and inner sheet or layer 104. The sides of the framework are formed by cutting three longitudinal v shaped score lines or grooves 108 into the outer sheet material 102 and core 106 but not through the inner sheet material 104. The grooves are cut into the surface that is intended to be the outer surface of the framework. The cut material is removed from the groove and the sheet may be folded at the score lines 108. The inner sheet material 104 acts as a hinge. The width of the sides 112, 120, 130, and 140 is selected so that the outer shell 20 wraps around and slightly contacts the exterior 102 of the frame 100. Cutouts or windows 152 extend through both layers 102 and 104 and the core 106. Mortises 150 are cut through each side and are adapted to receive tabs or tenons extending outward from the support 200. A longitudinal edge 114 extends along and defines a free end or edge of the first side 112. A plurality of spaced apart crosswise grooves or open sided mortises 116 are cut into the longitudinal edge 114. The grooves 116 are adapted for receiving corresponding tongue or tabs 144 extending from longitudinal edge 142 of the fourth side 140. When the grooves 116 and tabs 144 interlock an enclosed inner frame 100 is formed.

Figure 14:
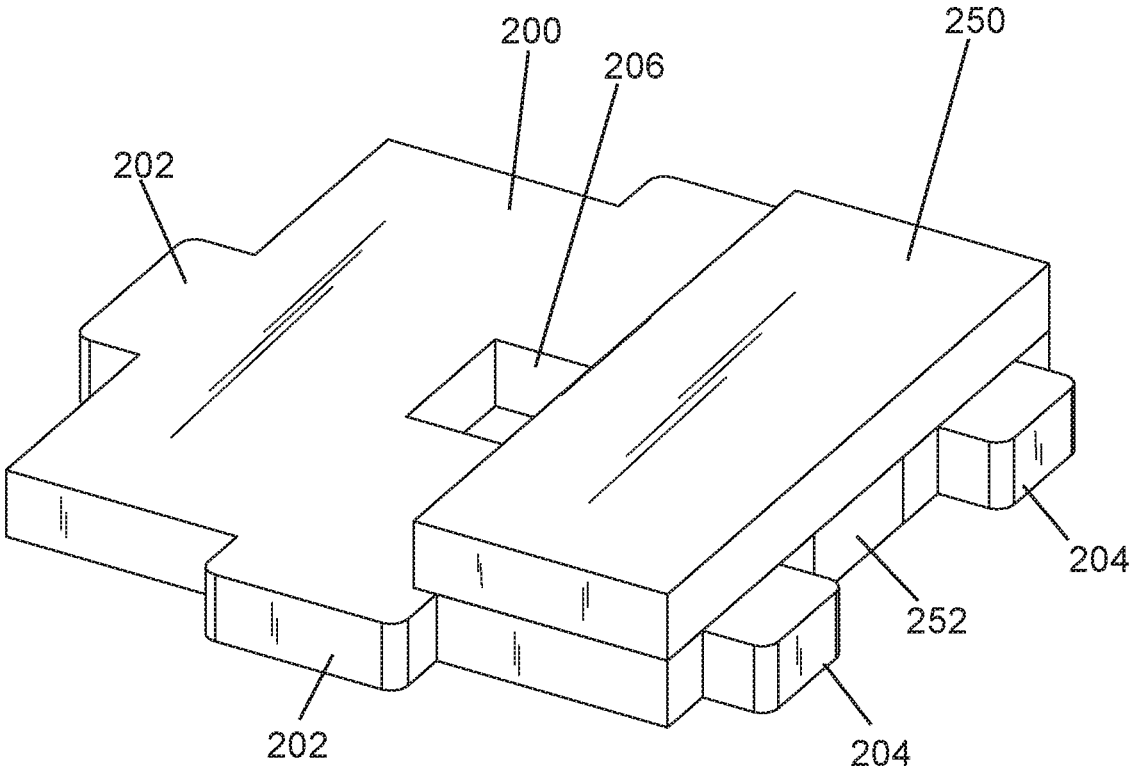
FIG. 14 is a top perspective view of a support and block of an inner frame of a display system of the present invention.
Figure 15:
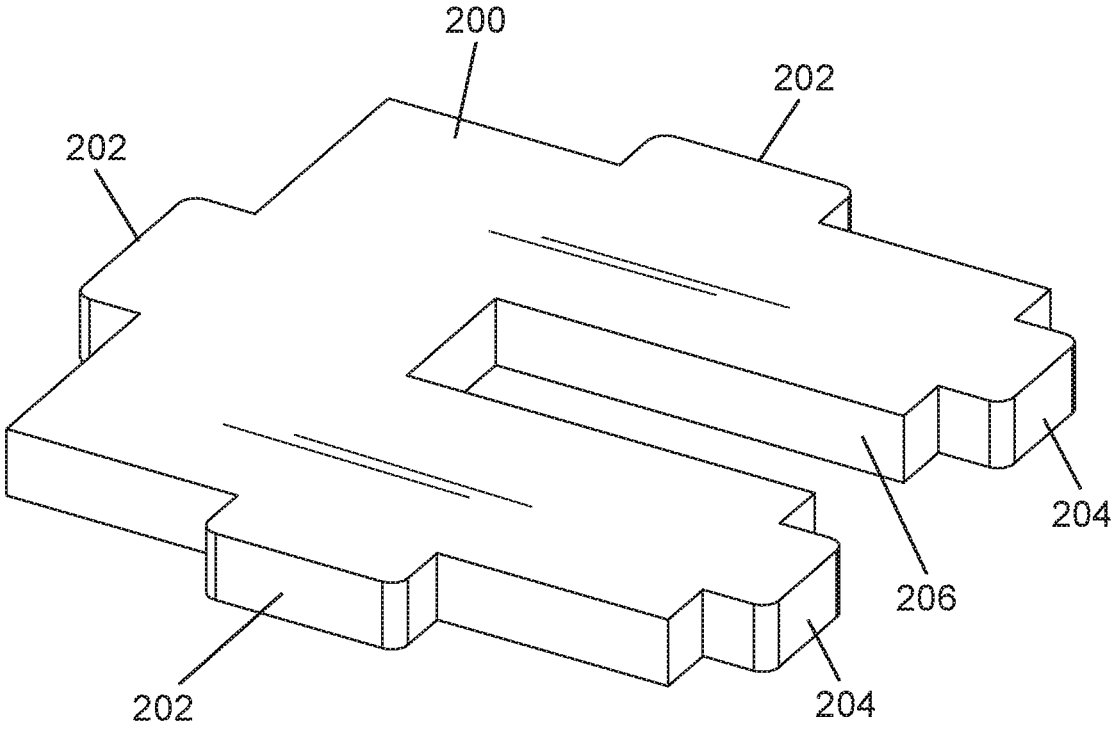
FIG. 15 is a top perspective view of a support of an inner frame of a display system of the present invention.
Figure 16:
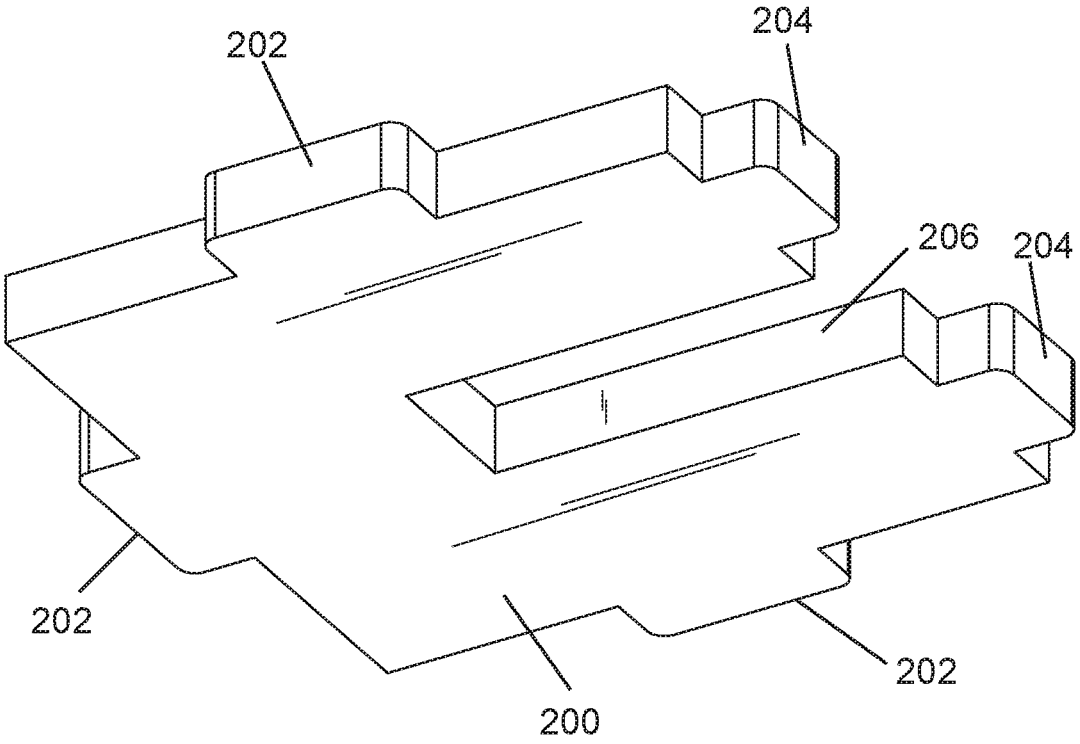
FIG. 16 is a bottom perspective view of the support of the type shown in FIG. 15.
Figure 17:
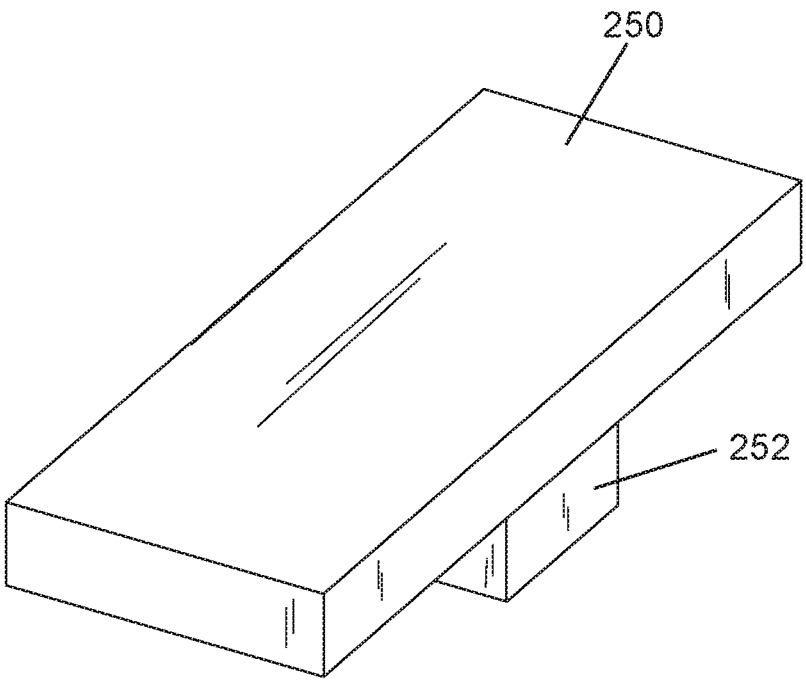
FIG. 17 is a top perspective view of a block of an inner frame of a display system of the present invention.
Figure 18:
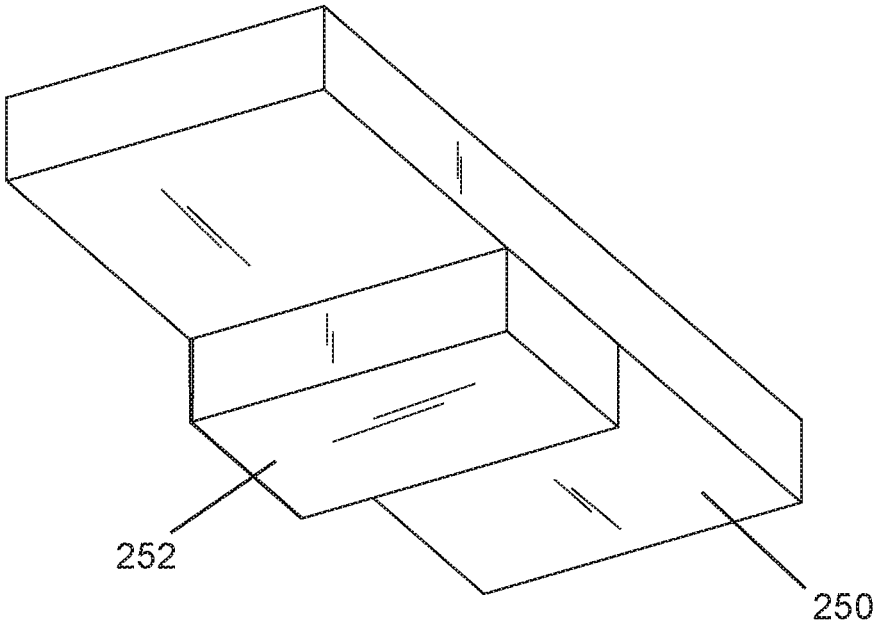
FIG. 18 is a bottom perspective view of the block of the type shown in FIG. 17.

Referring next to FIG. 14 the support 200 and block 250 are further illustrated. The block 250 includes a rail 252 (see FIGS. 17-18) that engages and slides within slot 206 extending from an outer edge of the support 200 towards a center of the support. The support 200 includes a single tab 202 extending from three of the sides of the support and a double tab 204 is formed on the fourth side of the support (see FIGS. 15 and 16). The single tabs 202 engage with the mortises 150 cut into the sides 112, 120 and 130 of the inner frame 100. The double tabs 204 engage the mortises 150 formed in the fourth side 140 of the inner frame. The block 250 may be slid inward toward the center of the support. When the frame 100 is installed at a retail store the frame may be elevated to surround a conduit extending downward from a ceiling region of the building. The conduit is positioned within the slot 206 of the support 200 and the block 250 is optionally but preferably slid to further confine the conduit within the slot 206. In this manner the frame may be held in place on a conduit and various outer shells 20 may be engaged to the frame 100.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A collapsible display column system for use in connection with a pole, the collapsible display column system comprising:

a collapsible outer shell having a top, bottom, and sides, wherein the top includes an aperture extending through the top and wherein the bottom includes an aperture extending through the bottom;

a collapsible inner frame that is enclosed by and in contact with the outer shell, the inner frame being formable from a flat sheet by folding the sheet about a plurality of hinges to define an inner surface, an outer surface, and at least three sides of the inner frame, each of a first hinge and a second hinge being integrally formed with the sheet, a first side of the inner frame having a hinged edge and a free edge, and a second side of the inner frame having a hinged edge and a free edge, wherein a tab extending from the free edge of the first side is engageable with a mortice in the free edge of the second side to secure the first side to the second side, thereby forming an enclosure of the inner frame, the inner surface of at least two sides of the inner frame including a mortice disposed between the respective hinged edge and the respective free edge;

a support having a perimeter surrounded by and in contact with the inner surface of the inner frame, the support having tabs extending from the perimeter for engagement within the mortices in the inner surface of the inner frame to secure the support to the inner frame, the support including a slot; and a block having a rail that is slideably engageable with the slot of the support such that the block is moveable with respect to the support while engaged with the support between a first position wherein the block is out of contact with the pole, and a second position wherein the block is in contact with the pole to secure the collapsible display column system in a releasably fixed position in relation to the pole that extends through the top and bottom apertures of the collapsible outer shell and through the slot of the support.

2. The collapsible display column system as recited in claim 1, wherein the outer shell may be formed from flat sheets of material, the flat sheets of material having an outer layer, an inner layer, and a core separating the outer layer and inner layer.

3. The collapsible display column system as recited in claim 2, wherein the flat sheets of material are selected from the group consisting of cardboard or foam board.

4. The collapsible display column system as recited in claim 2, wherein the outer shell is formed by cutting three longitudinal v shaped score lines or grooves into one side but not completely through the sheet material.

5. The collapsible display column system as recited in claim 4, wherein the grooves are cut into the side of the sheet material that is intended to be the internal surface of the outer shell.

6. The collapsible display column system as recited in claim 1, wherein the outer shell is made from two pieces of sheet material having equal widths.

7. The collapsible display column system as recited in claim 6, wherein a single score line is cut into each sheet material and each sheet material is folded along the score line.

8. The collapsible display column system as recited in claim 7, wherein the two folded sheets are combined to form a four-sided column.

9. The collapsible display column system as recited in claim 1, wherein flat sheet of the inner frame is made from a material having a core that separates outer and inner sheets.

10. The collapsible display column system as recited in claim 9, wherein the flat sheet material is a corrugated board or honeycomb board.

11. The collapsible display column system as recited in claim 10, wherein the first and second hinges may be formed by cutting respective longitudinal grooves into the outer sheet and the core of the flat sheet material but not through the inner sheet of the flat sheet material.

12. The collapsible display column system as recited in claim 1, wherein the outer shell, inner frame and support are made of sustainable material and assembly of the collapsible display column system is accomplished without fasteners.

* * * * *